6/2/87 XR 4,670,290

United States Patent [19]

Itoh et al.

[11] Patent Number: 4,670,290

[45] Date of Patent: Jun. 2, 1987

[54] MULTIPLE TORCH TYPE PLASMA SPRAY COATING METHOD AND APPARATUS THEREFOR

[75] Inventors: Tsutomu Itoh, Tokyo; Haruo Tateno, Kiyose; Hideo Nagasaka, Hitachi; Masahiro Yamamoto, Sakura; Yusuke Mitsuyoshi, Tokyo; Susumu Matsuno, Ichikawa; Hiroshi Saitoh, Funabashi; Masayuki Kitoh, Higashikurume, all of Japan

[73] Assignees: Rikagaku Kenkyusho, Saitama; Onoda Cement Company, Ltd., Yamaguchi, both of Japan

[21] Appl. No.: 862,040

[22] Filed: May 12, 1986

[30] Foreign Application Priority Data

May 13, 1985 [JP] Japan ..... 60-101082

[51] Int. Cl.[4] ..... B05D 1/08

[52] U.S. Cl. ..... 427/34; 219/121 PP; 239/85; 427/423

[58] Field of Search ..... 427/34, 423; 219/121 PP, 121 PQ, 121 PR, 121 PU, 121 PV; 239/79, 81, 85

[56] References Cited

U.S. PATENT DOCUMENTS

| | | | |
|---|---|---|---|
| 3,312,566 | 4/1967 | Winzeler et al. | 219/121 PQ |
| 3,628,079 | 12/1971 | Dobbs et al. | 219/75 |
| 3,770,935 | 11/1973 | Tateno et al. | 219/121 PP |
| 4,013,867 | 3/1977 | Fey | 219/121 PR |
| 4,024,373 | 5/1977 | Bykhovsky et al. | 219/75 |
| 4,032,744 | 6/1977 | Coucher | 219/74 |
| 4,146,654 | 3/1979 | Guyonnet | 219/121 PP |
| 4,275,287 | 6/1981 | Hiratake | 219/121 PP |
| 4,439,662 | 3/1984 | Tateno | 219/121 PQ |
| 4,596,918 | 6/1986 | Ponghis | 219/75 |

*Primary Examiner*—John H. Newsome

*Attorney, Agent, or Firm*—Price, Heneveld, Cooper, DeWitt & Litton

[57] ABSTRACT

A multiple torch type plasma spray coating method and a multiple torch type plasma spray coating apparatus in which a main torch and an auxiliary torch are disposed so that their center axes may intersect each other, is improved in that laminar flow plasma is generated by the main torch, spray coating material is charged into the plasma flame in the proximity of the outlet of the main plasma torch, the plasma flame is blown onto an object to be treated, plasma is separated from the plasma flame just in front of the object to be treated, and the then left spray coating material is made to deposit onto the object to be treated.

16 Claims, 16 Drawing Figures

MULTIPLE TORCH TYPE PLASMA SPRAY COATING METHOD AND APPARATUS THEREFOR

BACKGROUND OF THE INVENTION

1. FIELD OF THE INVENTION

The present invention relates to improvements in the so-called plasma spray coating technique, in which materials such as metals, ceramics, etc. are molten by means of a heavy current flowing through gas, i.e., the so-called arc or high-temperature plasma generated by the heavy current, and they are sprayed against an object to be treated for forming a strong coating film on its surface.

2. DESCRIPTION OF THE PRIOR ART

A heretofore known plasma spray coating apparatus is the apparatus illustrated in FIG. 16, in which a cathode 1 of the apparatus is held concentrically with an anode nozzle by means of an insulator 12 so that a tip end of the cathode 1 may come to the proximity of an inlet of a nozzle pipe passageway 25 of the anode nozzle, and at the upstream of the tip end, plasma gas 8 is charged through a plasma gas charging port 7. A negative side of a power source 3 is connected to the cathode 1 by a lead 5, and a positive side of the power source 3 is connected to the anode nozzle 2 through an exiting power source 4 by a lead 6. It is to be noted that reference numeral 13 designates a cooling system, the interior of the anode nozzle 2 is normally constructed in a double structure, though not shown, and the interior is adapted to be continuously cooled by softened coolant water or the like through pipings 14 and 15. Now, if a high-frequency voltage is applied by an exciting high-frequency power source 4 between the cathode and the anode while a D.C. voltage is applied therebetween by a power source 3 and as making plasma gas, normally inert gas such as argon shown by arrows 8 and 9 flow through the anode nozzle 2, then arc is generated from the tip end of the cathode 1 towards an inner surface 105 of the nozzle pipe passageway 25 of the anode nozzle 2. Since such short arc is apt to damage an inner wall of the nozzle pipe passageway 25 of the anode nozzle 2, i.e., a nozzle pipe wall 26, a large amount of plasma gas 8 is made to flow so that arc 11 may be formed within the nozzle pipe passageway 25 over a distance as long as possible to form an anode point 10 far from the tip end of the cathode 1. The plasma gas flowing through the nozzle pipe passageway 25 of the anode nozzle 2 is strongly heated up to a high temperature by the thus formed arc 11, it takes a state of the so-called plasma flame 16 and is ejected from the tip end of the anode nozzle. At this moment, if spray coating material 18 is charged through a material charging pipe 17, then the material is mixed in the plasma flame 16 at a high temperature ejected from the anode nozzle 2, and momentarily converted to molten material 20 to be sprayed onto an object to be treated, i.e., a substrate 22, and thereby a coating film 21 is formed on the surface of the substrate. It is to be noted that in a certain case the spray coating material 18 is fed to just behind an outlet of the anode nozzle 2 as illustrated by the material charging pipe 17, but in another case the material charging pipe is disposed just in front of the outlet of the anode nozzle 2 as shown by arrow 23. In either case, in this type of plasma spray coating apparatus used in the past, an extremely large amount of gas was used to form long arc 11 within the anode nozzle 2 for preventing corrosion of the inner wall 26 of the anode nozzle 2 and to cool the nozzle pipe wall 26 of the anode nozzle 2 by means of the plasma gas 8 and 9, the ejecting speed of the plasma flame 16 at the tip end of the anode nozzle 2 was normally maintained at an extremely high speed condition in the range of Mach 0.5 to Mach 3, consequently, in the spray coating apparatus in the prior art, very violent noises of the order of 110 phons to 120 phons were generated, and therefore, the plasma spray coating apparatus had a great disadvantage that normally the operation of the apparatus was possible only within an isolated soundproof room, and an operator for operating the apparatus could not be in charge of manipulation for operating the apparatus unless he wore a noise protecting device. Furthermore, since the plasma gas ejected from the tip end of the anode nozzle 2 normally forms a violent brilliant flame containing a large amount of ultraviolet rays, it is impossible to directly look at the flame, and so, an operator of the apparatus is compelled to wear ultraviolet rays protecting glasses. In addition, for the plasma gas used in the spray coating apparatus in the prior art, normally expensive inert gases such as argon, helium, hydrogen, etc. are used. This is because if gases having a strong activity such as air, oxygen or the like are used as the plasma gas, the nozzle pipe wall 26 is quickly oxidized and worn and continuous operation for a long period becomes impossible. Since these inert gases are expensive and they are consumed in a large amount for the purpose of generating a high speed within the nozzle, there is also a large shortcoming that an extremely high operating cost is required. Moreover, in the plasma spray coating apparatus in the prior art, the plasma flame 16 ejected from the tip end of the apparatus has an extremely strong turbulent flow condition due to its remarkably high speed, and therefore, as shown by arrows 27 a large amount of atmospheric air in the proximity of the ejecting port is swirled and sucked, resulting in a quick lowering of the temperature of the plasma gas. Accordingly, in order to carry out spray coating under a proper condition, the distance between the tip end of the anode nozzle 2 and the substrate 22 is required to be maintained extremely precisely, if this is deviated it becomes very difficult to form a proper coating film, accordingly, extremely severe control for an operating condition is required for the purpose of quality control of the coating film, and so, quality control is not easy. In addition, in the heretofore known plasma spray coating apparatus, since an extremely large amount of high speed gas is violently sprayed towards the substrate 22 in view of the situation as described in detail above, the substrate 22 is limited to that having a high strength, and the apparatus is not suitable for micro-fine working. Also, the plasma spray coating apparatus in the prior art had a shortcoming that inert gas such as argon, helium, etc. is used as the plasma gas 8, and hence the cost of the plasma gas becomes high.

SUMMARY OF THE INVENTION

One object of the present invention is to prevent generation of violent sound and intense light containing ultraviolet rays and impossible to be directly looked at, which obstructs wide popularization of a plasma spray coating apparatus in the prior art; another object is to save the amount of expensive gas consumed by the operation and to make it possible to operate the apparatus even by employing less expensive gas such as air or the like and also, from a different view point, even by employing strongly reactive gas such as air, oxygen, etc.; and yet another object is to provide a novel plasma spray coating apparatus in which control of operating conditions such as a distance between an apparatus and a substrate can be allowed to be generous, wear of component parts can be made little, continuous operation for a long period is possible, and even working of a substrate having a relatively weak strength is possible, and which apparatus is suitable for micro-fine working.

An essence of the present invention is that arc for generating plasma is provided by means of two arc torches, a start point and an end point of arc are surely fixed by these two torches, there is provided means for reliably preventing wear of not only a cathode start point of the arc but also an electrode forming an anode end point of the arc by means of inert gas, and thereby the apparatus is made to be operable even with a small amount of plasma gas, and this is a first great characteristic feature. A second great characteristic feature is that normally the generated plasma is made to take a laminar flow state by an inherent structure, enthalpy of the plasma is greatly improved, thereby generation of noises is suppressed, at the same time, the plasma is separated from a plasma flame containing coating film material which is heated in the laminar flow plasma and traveling in a form of liquid drops towards an object to be treated, that is, a substrate by making use of plasma separating means just in front of the substrate, thereby damage of the substrate caused by the plasma is suppressed, also the coating film material heated up to an extremely high temperature to be molten is, after an extremely short flying distance, immediately sprayed onto the surface of the substrate, and thereby even at a relatively slow speed, a coating film having an excellent performance can be formed. In addition, another characteristic feature is that an end point of arc is fixed in position by a plasma torch that is different from a plasma torch defining a start point of the arc, by reliably protecting the end point by means of inert gas it becomes possible to use gases having a violent activity such as oxygen, air, etc. easily over a long period of time as the plasma gas, and thereby even in the case of oxides such as oxide ceramics, ferrite, etc., a coating film having very excellent properties can be formed by spray coating. Also, still another characteristic feature is that upon spray coating of oxide series materials, since most of the plasma gas may consist of air, great saving of an operating cost becomes possible.

In the plasma spray coating according to the present invention, since a start point and an end point of arc for generating plasma are reliably protected by inert gas and, if necessary, cooled and, upon excitation, the arc is successively transferred, the arc is once drawn out of the torch for forming the start point of the arc, and the arc is terminated with the torch for forming the end point of the arc, long arcs can be easily produced. Furthermore, as the end point of the arc, i.e., the anode point is protected by protecting inert gas, a flow rate of gas for generating plasma can be selected nearly independently of the length of the arc and a current value, and so, the range of setting of a flow rate of the plasma gas becomes very broad. Accordingly, it has become possible to operate the apparatus continuously for a long period and reliably under the state where the plasma flame forms a laminar flow. Thereby it has become easy to maintain the noises generated in association with spray coating at a low value of the order of 70–80 phons. In the plasma spray coating according to the present invention, despite of the fact that a flow rate of plasma gas is small, with regard to the arc current value it is possible to operate at a considerably large value, also since the arc is long, the potential difference between the start point and the end point of the arc, that is, the arc voltage can be chosen large, after all an electric power effectively consumed by the arc which is determined by the product of the arc current by the arc voltage becomes large, and as a result, the temperature and the enthalpy of the generated plasma would become remarkably large. Consequently, melting of the spray coating material can be realized very reliably. Furthermore, the laminar flow plasma flame which is mainly employed in the spray coating according to the present invention, very scarcely swirls and sucks environmental gas during its flying, resulting in lowering of a temperature, hence the spray coating material which has been molten and has become liquid drops would travel straightly towards the object of spray coating as carried by this laminar flow flame, and so, it is seldom that the spray coating material lowers in temperature as it is flying. And just in front of the object to be spray-coated only the plasma is separated, and thereafter the spray coating material strikes against the object to be spray-coated after a very short flying time, during its temperature is not lowered. Accordingly, despite the fact that a flying speed is a low speed, that is, a fraction of that of the spray coating in the prior art, an extremely rigid coating film having an excellent performance can be obtained. In addition, in contrast to the fact that in the spray coating in the prior art, the charging point of spray coating material was always located within the plasma flame that is downstream of the arc, in the spray coating according to the present invention, the spray coating material can be directly charged into the arc that is upstream of the end point of the arc or can be charged into the arc that is generating a plasma flame, so that electric power of the arc contributes directly to melting of the spray coating material, and from this view point also, melting of the spray coating material can be effected at an extremely high efficiency. Furthermore, in the spray coating according to the present invention, the plasma flame used for spray coating is a laminar flow flame, the extension of the flame is small, and a flying speed of the plasma flame is low, so that it is scarce that a large force is exerted upon an object of spray coating, hence, the spray coating can be easily applied even to an object to be spray-coated having a small strength, and even micro-fine working can be effected through the plasma spray coating.

In the spray coating according to the present invention, a great characteristic feature of the spray coating by the weld torch is that since the start point and the end point of the arc are reliably protected by inert gas or by cooling and provision is made such that plasma gas is charged as divided from separate locations to the start point and the end point of the arc, gases having a remarkably high activity such as oxygen, air, etc. can be used as the plasma gas, and this could not be realized in the spray coating in the prior art. Thereby, the material properties of the plasma flame can be arbitrarily chosen, and it becomes possible to obtain a coating film having an inherent high degree of material properties by spray coating the materials such as ferrite, alumina, titania, etc., although it was impossible in the prior art to obtain a spray-coated film having a high degree of material properties. In addition, even in the case where a special performance is not required for the material of the coating film, in the case of, for example, oxide ceramics or the like, since it has become possible to utilize normal air as a most part of the plasma gas, this can reduce the amount of use of expensive inert gas and can greatly contribute to reduction of an operating cost.

In the plasma spray coating according to the present invention, if necessary, an outer sheath is provided around a plasma flame flying from a torch to an object of spray coating, thereby a violent brilliant flame containing ultraviolet rays generated from a plasma flame can be shielded, furthermore thermal loss caused by radiation from the plasma flame can be prevented by the outer sheath, hence temperature lowering of the plasma flame and the spray coating material can be prevented, so that temperature lowering can be surely prevented until the plasma is separated just in front of the object to be spray-coated, and this also very greatly contributes to provision of a coating film having an excellent performance.

In the plasma spray coating according to the present invention, owing to the fact that spray coating film is directly charged into the arc and the enthalpy and temperature of the plasma flame are very high, melting of the spray coating material is effected in an extremely short period of time, and in the subsequent flying process, since the plasma forms a laminar flow frame, the spray coating material flies straightly towards the object to be spray-coated, the point where separation of plasma is to be effected can be set at any arbitrary position at a distance of about 2.5–30 cm from the outlet of a torch, this distance can be selected in accordance with the shape of the object to be spray-coated and a required performance of the coated film, and thereby the applicable range of spray coating can be chosen to be very broad. In addition, it is preferable to charge gas having appropriate components, if necessary, into the flame outer sheath and a connecting chamber. Thus, control of the gas components of the plasma flame can be effected extremely reliably, so that even in the case of spray coating materials whose change in nature caused by oxidation or the like is extremely unfavorable such as metals, quality control of the coating film can be reliably achieved. In addition, in the case where gas exhaust is utilized as plasma separating means, harmful gas produced as a result of formation of plasma, for instance, $NO_x$ which is liable to be produced in the case of utilizing air or nitrogen as the plasma gas, and a most part of the spray coating material not deposited to the object to be spray-coated can be surely collected thereby, so that this can greatly contribute prevention of generation of violent sound as well as violent radiation containing ultraviolet rays and also the improvements in environment for spray coating work, and spray coating can be introduced to a production process similarly to a conventional machine tool without any special additional device.

DESCRIPTION OF THE PREFERRED EMBODIMENTS

Figure 1:
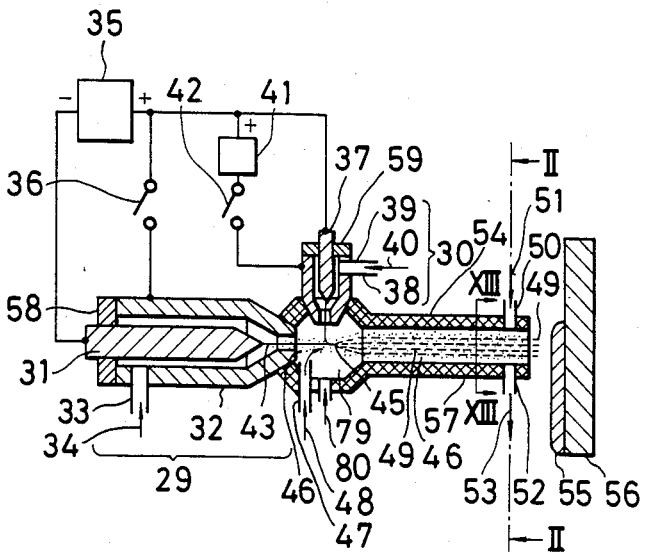
FIG. 1 is a longitudinal cross-section view of one preferred embodiment of the present invention.
Figure 2:
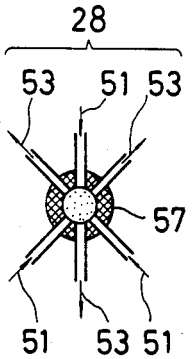
FIG. 2 is a cross-section view taken along line II—II in FIG. 1.

FIG. 1 is a first example of illustration of a mode of embodying a plasma spray coating apparatus according to the present invention. In this figure, a main cathode 31 is held concentrically with respect to a main outer sheath 32 whose tip end surrounds the main cathode and which has a discharge port by means of an insulator 58, and a main plasma gas is charged through a main gas charging port 33 provided in the main outer sheath, as shown by arrow 34. A negative terminal of a main power source 35 is connected to the main cathode 31, a positive terminal of the main power source 35 is connected via switch means 36 to the main outer sheath 32, and these form, as a whole, a main torch. In addition, there is an auxiliary cathode 37 which is disposed so as to intersect a center axis of the main torch, that is, a center axis of the main cathode 31, an auxiliary first outer sheath 38 surrounding this auxiliary cathode 37 and having an ejecting port at its tip end is provided concentrically with the auxiliary cathode 37, and this auxiliary outer sheath 38 is provided with an auxiliary gas charging port 39 as shown by arrow 40. An auxiliary power source 41 has its negative terminal connected via switching means 42 to the auxiliary first outer sheath 38, and a positive terminal of the auxiliary power source 41 is connected to both the auxiliary cathode 37 and the positive terminal of the main power source 35.

Figure 16:
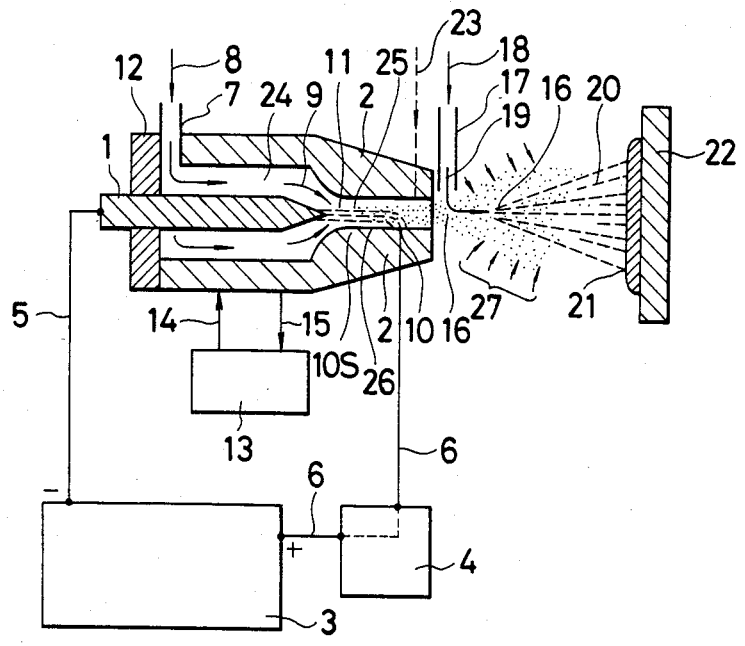
FIG. 16 is a longitudinal cross-section view of an apparatus in the prior art.

In FIG. 1, as the plasma gas shown by arrow 34, inert gas such as argon or the like is made to flow, the switch means 36 is closed to apply the voltage of the main power source 35 between the main cathode 31 and the main outer sheath 32, and if the main torch is excited by means of an exciting power source not shown, then an exciting arc 43 is formed from the tip end of the main cathode 31 towards the ejecting port of the main first outer sheath, thereby the main plasma gas is heated and becomes plasma 46, and it is ejected from the tip end of the main outer sheath towards the exterior of the torch 29. Subsequently, the switch means 42 is closed to apply the voltage of the auxiliary power source 41 between the auxiliary cathode 37 and the auxiliary outer sheath 38, and if inert gas such as argon or the like is charged as an auxiliary plasma gas as shown by arrow 40, then an auxiliary torch exciting arc 44 is generated, and plasma is ejected from the ejecting port at the tip end of the auxiliary outer sheath. Thus, the plasmas ejected from the tip ends of the main torch and the auxiliary torch would intersect just in front of the tip ends because the center axis of the main torch 29 and the center axis of the auxiliary torch 30 are disposed so as to intersect each other, and since the plasma 46 is conductive, under the above-mentioned condition, a conducting passageway relying upon the plasma 46 extending from the tip end of the main cathode 31 to the tip end of the auxiliary cathode 37 is formed. If the switch means 36 and 42 is turned OFF after the above-mentioned condition has been established, then the voltage of the main power source 35 is applied between the tip end of the main cathode 31 and the tip end of the auxiliary cathode 37, and thereby a stationary hair-pin arc 45 extending from the tip end of the main cathode to the tip end of the auxiliary cathode 37 can be formed. In this case, if the structure of the main torch 29, the flow rate of the main plasma gas fed to the main torch 29, the structure of the auxiliary torch 30, and the flow rate of the auxiliary plasma gas fed to the auxiliary torch 30 are appropriately chosen, then as shown in FIG. 1, a plasma flame 54 that is almost coaxial with the main torch 29 can be generated. The thus generated stationary hair-pin arc 45 has its start point and end point surely fixed, respectively, at the tip end of the main cathode 31 and at the tip end of the auxiliary cathode 37, and also these tip ends are protected by inert gas, so that there is no need to make gas flow at a large flow rate for the purpose of cooling the inner wall of the anode nozzle 2 which serves as the end point of the arc as is the case with the plasma spray coating apparatus in the prior art as shown in FIG. 16, and hence it is possible to set the flow rate of the main first plasma gas passed through the main torch 29 at an arbitrary flow rate from a small flow rate to a large flow rate over an extremely broad range.

It is to be noted that in the above-described structure, normally both the inner walls of the main outer sheath 32 and the auxiliary outer sheath 38 have a double structure, and they are cooled by circulating water or the like through the interior of the double structure, but the detailed structure is omitted from illustration. Also, in the following description, the corresponding cooling system is omitted from explanation and illustration.

Figure 3:
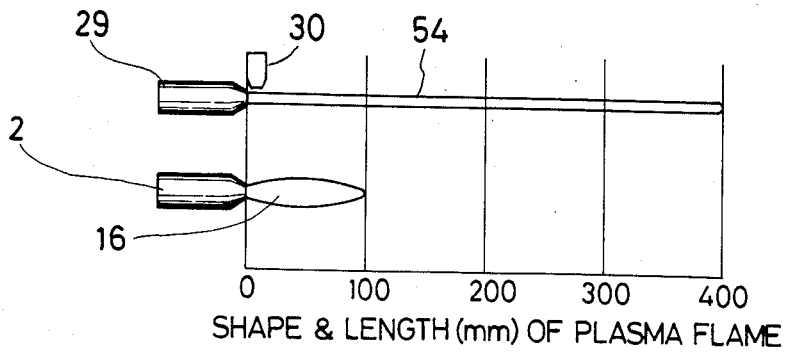
FIG. 3 is a diagram showing comparison of a shape and a length of a plasma flame according to the present invention to those in the prior art.

By means of the two torches shown in FIG. 1, arc having its start point and end point fixed is generated between electrodes having their respective tip ends protected by inert gas, and by heating plasma gas with this arc to generate plasma, a flow rate of the plasma gas in the main torch 29 can be set at any arbitrary flow rate over an extremely broad range. Also, paying attention to a flow of electrons, the plasma gas in the auxiliary torch 30 forming the end point can suffice with a very small flow rate, and hence a plasma flame 54 generated according to this system can have its flow speed arbitrarily set over an extremely broad range. Also, in a stationary operating condition, since the exciting arcs 43 and 44 in the respective torches are not present, the interiors of the ejecting ports at the tip end of the respective outer sheaths would be little worn, and so, continuous stable operation for an extremely long period becomes possible. Especially, according to the present invention, it is one of important essential constitutive conditions that in the system having a basic construction as shown in FIG. 1 it is intended that the condition where a plasma flame formed in the range of small flow rate of the plasma gas forms a laminar flow, is applied to spray coating. FIG. 3 diagrammatically shows a remarkable difference between a shape of the plasma flame to be used for plasma spray coating in the heretofore known system shown in FIG. 12 and a shape of the plasma flame 54 generated by the main torch 29 and the auxiliary torch 30 according to the present invention. More particularly, in FIG. 3, reference numeral 16 designates a representative example of a turbulent flow plasma flame generated by the anode nozzle 2 in the plasma torch for spray coating in the prior art, and since this plasma flame 16 forms a remarkable turbulent flow, as soon as the plasma flame 16 comes out of the plasma torch, a large amount of associated gas is sucked and expands quickly, its temperature is lowered quickly within a short distance, and normally after a plasma flame of about 100 mm in length has been formed, it disappears, whereas in the main torch 29 for spray coating and the auxiliary torch 30 for spray coating according to the present invention whose basic construction is shown in FIG. 1, the generated plasma flame 54 basically forms a laminar flow, and even after it has been ejected from the torch, since the associated air would not be swirled and sucked into the plasma flame, the length of the plasma flame 54 is long as shown in FIG. 3, and it is a great characteristic feature that expansion of the plasma flame is extremely small. In contrast to the fact that the plasma flame 16 generated from the plasma torch according to the prior art system generates violent noises of about 110 to 120 phons, the laminar flow plasma flame 54 according to the present invention has a great characteristic feature that only low noise of about 70–80 phons is generated. In FIG. 3, in the anode nozzle 2 of the plasma torch for spray coating in the prior art system, an electric power of about 60 KW is supplied and in association with that electric power, inert gas of 60 l/min. is consumed, whereas in the case of the plasma flame 54 generated by the two plasma torches 29 and 30 in the system shown in FIG. 1 according to the present invention, an electric power input to the torches is 15 KW, while the consumed plasma gas is about 4.5 l/min. As will be apparent from these facts, since the plasma 46 generated in the system according to the present invention is at a high temperature and has an extremely high enthalpy, the spray coating material charged into this plasma flame 46 is quickly heated up to a high temperature and the associated gas is not swirled and sucked into the flame. Therefore, there is a great characteristic feature that temperature lowering of the plasma flame and the spray coating material during flying is very little. However, an ejecting speed of plasma is the highest at the tip end of the torch 29, it is lowered as a flying distance increases, and the spray coating material flying in association with the plasma also has its flying speed lowered, so that it is not favorable for forming a good coating film to spray the material onto the substrate after flying over an unnecessary long distance. Means for resolving this problem is plasma separating means which forms a important constituent element of the present invention. According to the present invention, as shown in FIG. 1, besides the first constituent essential condition that stable and low-speed plasma is generated by making use of two torches and this plasma is utilized for melting spray coating material, as its second constituent essential condition, in a laminar flow plasma flame which will become long if kept intact, only the plasma is separated at an arbitrary point and means is introduced for spraying only the coating film material in a molten drop shape onto a substrate just after the separation, and thereby a principal part of the present invention is completed.

In FIG. 1, coating film material 48 charged through a material charging pipe 47 towards the plasma flame 54 is momentarily heated up to a high temperature by strong laminar flow plasma 46 at a high temperature and having a high enthalpy and is molten, and as illustrated as molten coating film material 49, it travels towards the substrate 56 as associated with the plasma flame 54 without expanding so much. This plasma flame 54 containing the molten coating film material 49 has only the plasma separated therefrom by plasma separating means 28 disposed just in front of the substrate 56, and immediately thereafter the molten coating film material strikes against the substrate 56 to form a strong rigid coating film 55. As the plasma separating means, various methods can be conceived, but the simplest method is to provide a plasma separating gas feed port 50 and to charge gas through this port so as to intersect the plasma flame 54 as shown by arrow 51. It has been discovered that by appropriately selecting the flow rate of this charged gas, only the plasma having a small specific gravity is separated from the plasma flame 54 containing liquid drops of the molten coating film material 49, moreover the coating film material 49 having a large specific gravity and held in a molten state is almost not cooled, and immediately thereafter it strikes against the substrate of 56 to form a coating film 55, and thereby the present invention has been completed. Besides, as means for separating the plasma, it is possible to separate the plasma by effecting gas exhaust by a plasma separating gas exhaust port 52 just in front of the substrate 56 as shown by arrow 53 and to prevent damage of the substrate 56, and it is also possible to effect separation of plasma by jointly making use of gas feed and gas exhaust. According to the present invention, since coating film material is sufficiently molten by laminar flow plasma having a high enthalpy and low noise, there is no need to make use of a spraying speed at an ultra-high speed of Mach 0.5–Mach 2 or 3 as is the case with the spray coating with turbulent flow plasma in the prior art, and it is easy to realize an adhesion strength or a strength of a coating film itself which is equal to or higher than those in the case of the plasma spray coating in the prior art. In addition, according to the present invention, temperature distribution within the laminar flow plasma has relatively good uniformity, hence the temperature does not distribute so widely that the temperature to which the molten particles is exposed is not greatly different depending upon their locus of flight, and therefore, a coating film having extremely high uniformity can be formed. Furthermore, since the laminar flow plasma flame according to the present invention would not expand so large normally, by providing a flame outer sheath 57 made of refractory material and enclosing the flying plasma flame 54, it has become possible to reduce heat lost from the plasma and also to realize great improvements in the working environment by shielding violent light generated from the plasma flame 46 and containing strong ultraviolet rays.

In FIG. 1, reference numeral 79 designates a connecting chamber for connecting the main torch 29, the auxiliary torch 30 and the flame outer sheath 57 to prevent entrance of the external air, and depending upon an operating condition, in some cases necessary gas is charged into this connecting chamber as shown by arrow 80.

In the heretofore known spray coating apparatus shown in FIG. 16, the end point of arc during stationary operation, that is, the anode point 10 is adapted to be positioned always upstream of the spray coating material charging pipe 17 or 23. This is because if the anode point 10 should come downstream of the spray coating material charging pipe 17 or downstream of the spray coating material charging pipe position 23, the opening portion of the material charging pipe 17 would be damaged, and in order to prevent this, such construction is employed. However, in the spray coating apparatus according to the present invention, as shown in FIG. 1 the material charging pipe 47 for the coating film material 48 is positioned at a point upstream of the tip end of the stationary hair-pin arc 45 that is once drawn out of the main torch 29 and thereafter terminated at the auxiliary torch 28. This forms one of the very great characteristic features of the spray coating apparatus according to the present invention, and it is a great characteristic feature of the apparatus according to the present invention that the laminar flow plasma has high temperature and a high enthalpy as described above, hence not only melting of the coating film material 48 can be achieved more perfectly as compared to the spray coating apparatus in the prior art, but also a considerable portion of the coating film material 48 is charged into the hair-pin arc 45 itself, thereby a voltage drop of the arc itself rises, and consequently, a proportion of effective electric power used in the entire apparatus is improved by the corresponding amount by the charging of the material. Both the high temperature and enthalpy of the plasma 46 and the above-described characteristic feature become the reason why in the spray coating process in the apparatus according to the present invention, melting of the coating film material is perfect and it is easy to obtain a coating film performance equal to or higher as compared to a spray coating apparatus in the prior art, despite of the fact that the coating film material 48 strikes against the substrate 56 at a relatively low speed.

The preferred embodiment of the present invention shown in FIG. 1 and described in detail above, is a preferred embodiment consisting of the most basic features that two plasma torches are employed, the tip ends of the cathodes of the respective plasma torches are protected by inert gas, the coating film material 48 is molten by means of the plasma flame 54 produced by stationary hair-pin arc generated between these two plasma torches, then only the plasma is separated from this just in front of the substrate 56, and the molten coating film material 49 is sprayed onto the substrate 56.

Figure 4:
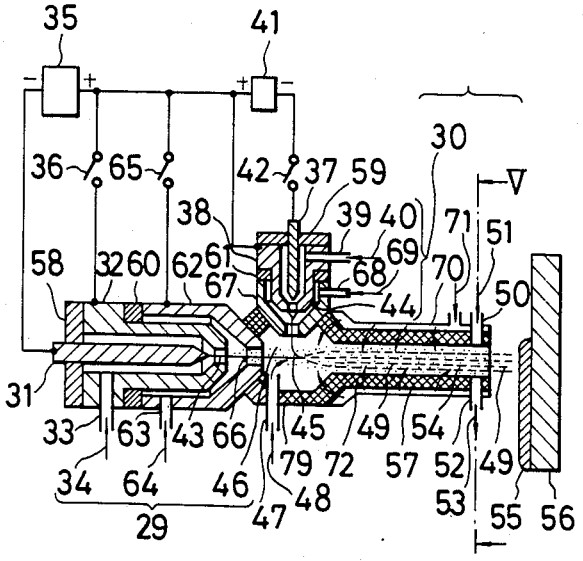
FIG. 4 is a longitudinal cross-section view of another preferred embodiment of the present invention.
Figure 5:
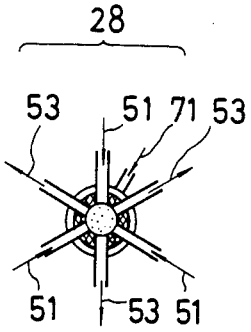
FIG. 5 is a cross-section view taken along line V—V in FIG. 4.

The illustration in FIG. 4 shows the basic constituent essential condition of one preferred embodiment of the present invention in which plasma spray coating is practiced by making use of gas that is very rich in reactivity such as oxygen, air, etc., which is the third one of the basic constituent essential conditions of the present invention. In FIG. 4, a main cathode 31 is supported by an insulator 58 concentrically with an outer sheath 32 which surrounds the main cathode 31 and has an ejecting port 43 and a main outer sheath gas charging port 33, a main second outer sheath 62 surrounding the main outer sheath 32 and having a narrowed port 66 is disposed so as to be concentric with the outer sheath 32 via an insulator 60, and a main second gas 62 of the main torch 29 is adapted to be charged into the space between the main outer sheath 32 and the main second outer sheath 62 through a main second gas charging port 63. Also, to an auxiliary cathode 37 is mounted an auxiliary first outer sheath 38 surrounding the auxiliary cathode 37 and having an ejecting port so as to be concentric with the auxiliary cathode 37 by an insulator 59, and further, auxiliary gas 40 is adapted to be charged through an auxiliary gas charging port 39.

In addition, an auxiliary second outer sheath 67 is mounted by means of an insulator 61 so as to be concentric with an auxiliary outer sheath 68, and auxiliary second gas 69 is charged through an auxiliary second gas charging port 68. A main power source 35 has its negative terminal connected to the main cathode 31, its positive terminal is connected to the main outer sheath 32 and the main second outer sheath 62 via switch means 36 and 65, respectively, and these form, as a whole, the main torch 29. An auxiliary power source 41 has its positive terminal connected to the positive terminal of the main power source 35 and the auxiliary outer sheath 38 of an auxiliary torch 30, a negative terminal of the auxiliary power source 41 is connected to the auxiliary cathode 37 via switch means 42, and these form, as a whole, the auxiliary torch 30.

The excitation of the respective torches in the preferred embodiment of the present invention shown in FIG. 4 is effected in the sequence as described in the following. That is, the switch 36 is closed to form exciting arc 43, at first, between the cathode 31 and the ejecting port of the main outer sheath 32 by means of the main power source 35, thereby main plasma gas 34 is heated, and conductive plasma is passed from the tip end of the main first outer sheath 32 through the narrowed port of the main second outer sheath 62, and thus ejected from the main torch. At this moment, if the switch means 65 is closed and subsequently the switch means 36 is opened, then the exciting arc 43 is extinguished via the already formed plasma, at the same time the arc ejected from the tip end of the cathode 31 forms main second outer sheath exciting arc 66, thereby the main plasma gas 34 and the main torch second gas 64 are heated, and a plasma flame 54 is ejected externally of the main torch 29. Next, if the switch means 42 is closed to form exciting arc 44 between the auxiliary outer sheath 38 and the auxiliary cathode 37 by means of the auxiliary power source 41, then the plasma gas 40 is heated by this arc, hence conductive plasma ejected from the ejecting port of the auxiliary outer sheath 38 is formed, this is further passed through the narrowed port at the tip end of the auxiliary second outer sheath 67, and conductive plasma is ejected externally of the auxiliary torch 30. When these processes have been finished, since the main torch 29 and the auxiliary torch 30 are disposed so that their center axes intersect each other, the conductive plasma ejected from the respective torches would form a conducting path, and if the switch 65 and the switch 42 are opened at this stage, then stationary hair-pin arc 45 is formed from the tip end of the main cathode 31 towards the outer surface of the narrowed port of the auxiliary outer sheath 38 by the main power source 35, at this moment by respectively regulating the flow rate of the gas charged into the main torch and the flow rate of the gas charged into the auxiliary torch, a plasma flame 54 that is nearly concentric with the center axis of the main torch can be formed as shown in FIG. 4. In this case, while inert gas such as argon or the like is used as the main plasma gas 34, the auxiliary gas 40 and the auxiliary second gas 69, for the main second gas 64 even if gases rich in reactivity such as air, oxygen, etc. are used, reaction such as oxidation or the like would not occur because the narrowed port at the tip end of the main second outer sheath 62 through which these gases pass is water-cooled internally, and accordingly, in the method according to the present invention as featured above, even if highly active gas is used as a principal component of the plasma gas, by selecting the flow rate of the main second gas 64 larger than that of other protective gases, continuous steady operation over a long period becomes possible. In this case, although the tip end of the cathode 37 of the auxiliary torch 30 is impossible to be water-cooled during steady operation in the conventional torch, if the torch is constructed in the above-described manner, then in normal steady operation, since the location where electrons flow in is the tip end of the auxiliary outer sheath 38, which is internally cooled and protected by the auxiliary second gas 69 and inert gas, wear of the tip end of the auxiliary torch 30 is almost not present as compared to the method according to the present invention illustrated in FIG. 1, and so, it becomes possible to maintain stable operation over an extremely long period of time. This is a great characteristic feature of the preferred embodiment of the present invention illustrated in FIG. 4. The essence of the preferred embodiment of the present invention illustrated in FIG. 4 can be summarized in that continuous stable operation can be achieved under such condition that active gas occupies a principal component of the plasma gas, and that mainly under such condition, laminar flow plasma can be generated.

Therefore, with respect to the point that a spray coating apparatus can be constructed by effectively utilizing the various merits of the laminar flow plasma that was disclosed in connection to the preferred embodiment shown in FIG. 1, the preferred embodiment shown in FIG. 4 is identical to the preferred embodiment in FIG. 1. However, in the embodiment shown in FIG. 4, the flame outer sheath 57 is formed, at least partly, of porous material or a perforated member, further it is covered by a flame outer sheath envelope 70, purge gas is charged into the space therebetween through the flame outer sheath envelope as shown by arrow 71, this purge gas is charged into the space of the plasma flame 54 through the flame outer sheath, and thereby cooling of the flame outer sheath 57 and regulation of the gas components within the space can be achieved. With regard to the means for separating plasma, the structure shown in FIG. 4 is identical to that shown in FIG. 1, and therefore, further explanation thereof will be omitted.

Figure 6:
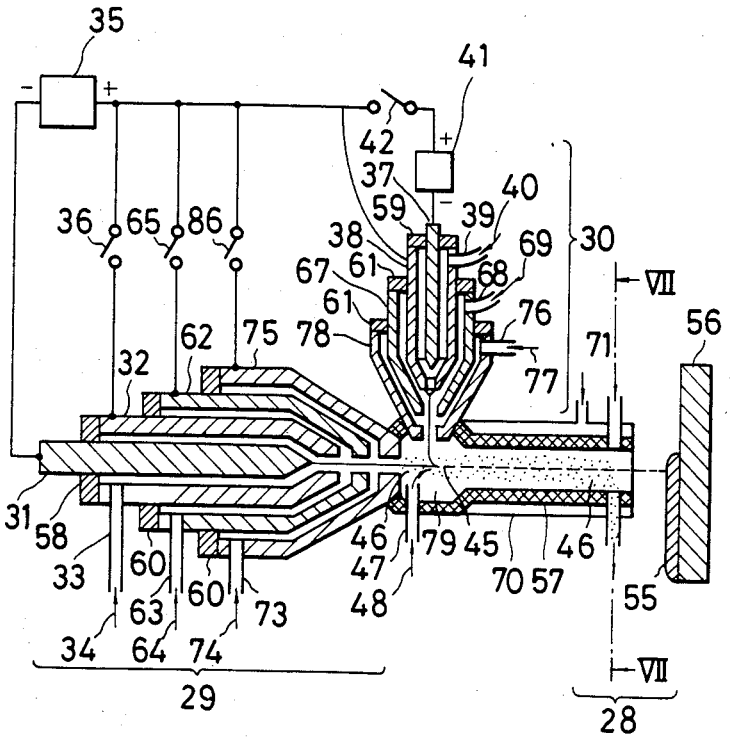
FIG. 6 is a longitudinal cross-section view of still another preferred embodiment of the present invention.
Figure 7:
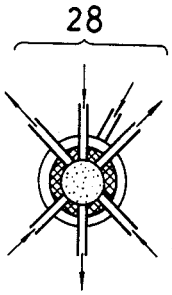
FIG. 7 is a cross-section view taken along line VII—VII in FIG. 6.

A third preferred embodiment of the present invention illustrated in FIG. 3 is an embodiment that is favorable in the case where an especially large capacity is required upon practicing the present invention, and in the case where it is desired to raise the proportion of active gas in the plasma gas. In FIG. 6, a third outer sheath 75 surrounding a main second outer sheath 62 of a main torch 29 and having a narrowed port at its tip end is disposed concentrically with the second outer sheath 62 by means of an insulator 61, and it is provided with a main third gas charging port 73 for charging main third gas 74 into the interior of the third outer sheath 75. A main power source 35 has its negative terminal connected to a main cathode 31, its positive terminal is connected to a main outer sheath 32, the main second outer sheath 62 and the main third outer sheath 75, respectively, through switch means 36, 65 and 86, and they form a main torch 29. In an auxiliary torch 30, an auxiliary third outer sheath 78 surrounding an auxiliary second outer sheath 67 and having a narrowed port at its tip end is disposed concentrically with the auxiliary second outer sheath by means of an insulator 61, and it is provided with an auxiliary third gas charging port 76 for charging auxiliary third gas 77 into the interior of the third outer sheath 78. An auxiliary power source 41 has its negative terminal connected to an auxiliary cathode 37, its positive terminal is connected to the positive terminal of the main power source 35 via switch means 42, in addition the auxiliary outer sheath 38 is also connected to the positive terminal of the main power source 35, as shown in FIG. 6, and these form, as a whole, an auxiliary torch 30. The main torch 29 and the auxiliary torch 30 are disposed so that their axes may intersect each other.

Upon excitation of the system shown in FIG. 6, the switch means 36 and 65 of the main torch 29 are successively closed and opened, only the switch means 86 is kept closed, further the switch means 42 of the auxiliary torch 30 is closed, then conductive plasma is ejected from the tip ends of the main torch 29 and the auxiliary torch 30, and after these plasmas have intersected and a conducting path consisting of plasma has been established between the cathodes of the respective torches, the switch means 86 and 42 are opened to produce stationary hair-pin arc, and thereby plasma 46 is generated. Thereby, similarly to the apparatuses shown in FIGS. 1 and 4, spray coating according to the present invention is effected by means of the apparatus shown in FIG. 6. In this system, while inert gas such as argon or the like is normally used as the respective charging gases shown by arrows 34, 40 and 69, respectively, and thereby protection of the electrodes and the outer sheaths can be achieved, for the plasma gas indicated by arrows 64 and 74 in the main torch 29 and arrow 77 in the auxiliary torch 30, active gas that is rich in reactivity such as air, oxygen, etc. can be used. Thereby, the proportion of active gas in the entire plasma gas used in the apparatus can be made high, and therefore, a coating film of the material which extremely hates reducing atmosphere and which can realize inherent high performances within oxidizing atmosphere such as ferrite, alumina, titania, etc., can be easily formed. This is a great characteristic feature of the present invention. In addition, in the main torch 29, since the plasma gas to be charged can be charged as divided into these passageways 34, 64 and 74, even when a large amount of gas is charged, the range where the generated plasma becomes laminar flow plasma, becomes broad, and so, this is very favorable in the case of operating the apparatus at a large capacity. In general, in the case where gas flows through a pipe passageway, it is necessary that the Reynolds number should be small, accordingly the limitation that the apparatus must be operated in the operating range where a gas flow is small, is liable to become a disadvantageous condition in the case where laminar flow plasma is employed in a spray coating apparatus. However, according to the present invention, by successively charging plasma gases 34, 64 and 74 is divided into three passageways according to the system shown in FIG. 6, generation of vortexes can be suppressed, the range of the flow rate of gas where the apparatus can be operated with a laminar flow can be greatly broadened, and on the other hand, in association with the fact that an enthalpy of the plasma generated according to this system is remarkably high as described above, it is possible to provide a large-capacity plasma spray coating apparatus that is not inferior to the plasma spray coating in the prior art. The plasma spray coating apparatus shown in FIG. 6 also provides an apparatus favorable for the object that extremely stable operation is realized even in continuous operation over a long period of time. In this case, upon excitation for the plasma gases 34 and 64 in the main torch 29, inert gas such as argon or the like is used, for the plasma gas 74 any appropriate gas is selected according to the object and thereby excitation is effected, but after the operation has entered steady operation, the operation is continued with the gas shown by arrow 34 reduced to a very minute flow rate or interrupted. If the apparatus is operated in this way, in the gas present within the space between the main cathode 31 and the main outer sheath 32, the components which wear the electrode such as oxygen, hydrogen, etc. contained therein is consumed out after a short period of operation after converted into such condition, so that thereafter wear of the tip end of the electrode 31 is substantially almost eliminated, and due to thermal equilibrium of plasma between the main cathode 31 and the main outer sheath 32, the plasma generated from the tip end of the main cathode 31 would have its performance determined depending upon only the shape of the tip end of the main outer sheath 32 which is always cooled relative to the exterior of the torch 29, substantially in association with the fact that wear of the tip end of the main cathode 31 is little, stability over a long period of the main torch 29 is further remarkably improved, and this also results in stabilization of the excitation performance of the main torch 29 as a whole. This would bring about remarkable merits for plasma torches which are operated by robots or the like and hence operated over a very long period without maintenance and inspection. Such method of operation that the apparatus is operated while the plasma gas charged into the space between the main cathode 31 and the main outer sheath 32 is reduced to a very minute flow rate or while the plasma gas is not charged at all, can be also applied, as a matter of course, to the auxiliary torch 30, and by employing such method, stability of the excitation performance of the auxiliary torch 30 can be remarkably improved. However, in these cases, depending upon the operating condition, in the case of the main torch 29 or in the case of the auxiliary torch 30, and in either case, inherent outer sheaths and means for charging gas into these which are provided for that purpose would become necessary, hence the apparatus would be somewhat large-sized and the structure would become complexed. However, in the case where an extremely high degree of automation is required, stabilization of the excitation performance and improvements in stability in long period operation would result in far greater merits than these problems.

In the system shown in FIG. 6, with regard to the functions of the plasma separating means 28, the flame outer sheath 57, the frame outer sheath envelope 70, the connecting chamber 79, etc., they are similar to those explained in connection to FIGS. 1 and 4, and therefore, further description thereof will be omitted.

Figure 8:
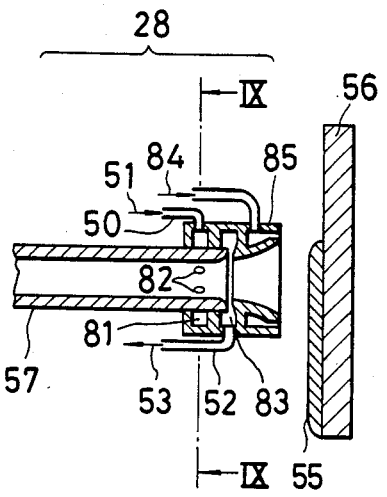
FIG. 8 is a longitudinal cross-section view showing a different preferred embodiment of a part of the present invention.
Figure 9:
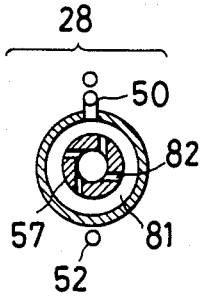
FIG. 9 is a cross-section view taken along line IX—IX in FIG. 8.

In FIG. 8 shows details of the plasma separating means disposed close to the substrate 56 in the plasma spray coating apparatus according to the present invention illustrated in FIGS. 1, 4 and 6. In the plasma separating means 28, plasma separating feed gas 51 should not be always blown towards the center axis of the plasma flame 54 at right angles thereto as shown in FIGS. 1, 4 and 6, in some cases it is more effective to blow it at an angle with respect to the direction of traveling of the plasma flame 54, and this is determined depending upon the size, the gas flow rate and the like of the plasma flame 54. In addition, as shown in FIG. 8, in some cases it is effective to once blow plasma separating feed air into a plasma separating feed gas annular chamber 81 provided close to the substrate 56 and to blow the plasma separating feed gas from this chamber into the portion of the outer circumference of the plasma flame 46 through gas feed ports 82 having a tangential component with respect to the plasma flame 54 especially so that a plasma separating effect may act effectively, and this is especially favorable for separating liquid drops of spray coating material having a low melting point and unmolten spray coating material in the outer peripheral portion of the plasma flame jointly with the plasma. In this case, at the downstream of the plasma separating gas feed ports 82, a plasma separating exhaust gas annular chamber 83 is provided, and by effecting gas exhaust through a slit and by means of this annular chamber as shown by arrow 53, the apparatus can be operated without exhausting unmolten spray coating material and nitrogen oxides produced in the case of employing air, nitrogen, etc. as plasma gas to the outside of the system, This is an extremely important characteristic feature of the present invention. In addition, according to the present invention, since the spray coating material strikes against the substrate 56 just behind the plasma separating means after flying over an extremely short distance and thereby form a strong rigid coating film, influence of mixing of inert gas into the plasma flame 46 can be surely prevented by sealing action of the flame outer sheath 57 and the connecting chamber 79, and this also forms a characteristic feature of the method according to the present invention. Furthermore, since the flame outer sheath can be made relatively thin because of the laminar flow flame, the apparatus is extremely advantageous in view of manipulation for operation. However, in order to further reliably prevent oxidation that is nevertheless caused by mixing of air or the like in the space between the tip end of the spray coating apparatus and the substrate, a protective gas annular chamber 85 is provided close to the substrate 56, inert gas shown by arrow 84 is charged from this chamber, and thereby it can be prevented that air or the like comes into contact with the molten spray coating material flying towards the substrate and induces undesirable reaction such as oxidation.

Figure 10:
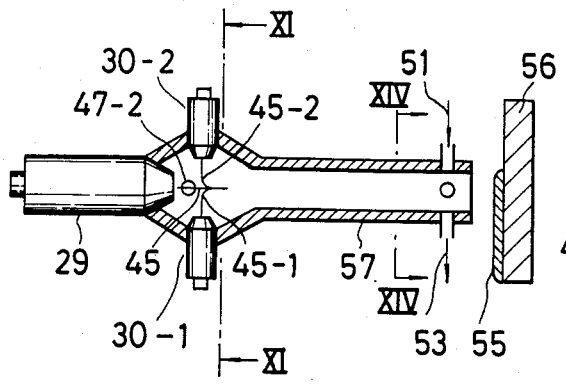
FIG. 10 is a longitudinal cross-section view showing another preferred embodiment of another part of the present invention.
Figure 11:
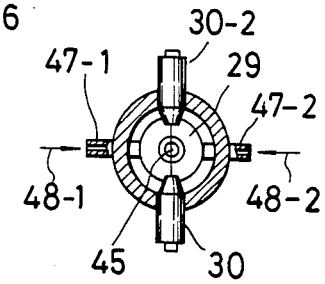
FIG. 11 is a cross-section view taken along line XI—XI in FIG. 10.

Plasma spray coating apparatuses shown in FIGS. 10 and 11 is one example of the apparatus in which in association with a single main torch 29, two auxiliary torches 30-1 and 30-2 are provided. In this apparatus, upon use, a stationary hair-pin arc 45-1 is generated between the main torch 29 and the auxiliary torch 30-1, and another stationary hair-pin arc 45-2 is generated between the main torch 29 and the auxiliary torch 30-2.

Figure 14:
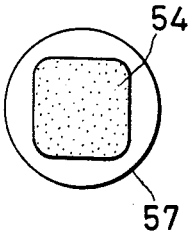
FIG. 14 is an enlarged cross-section view taken along line XIV—XIV in FIG. 10.

In addition, this apparatus is provided with a plurality of material charging pipes 47-1 and 47-2, and through these pipes, coating film materials 48-1 and 48-2 are charged. Accordingly, a cross-section configuration of a plasma flame 54 within a flame outer sheath 57 is nearly square as shown in FIG. 14, hence as compared to the case where a single auxiliary torch 30 and a single material charging pipe 47 are opposed to each other as shown in FIG. 1 and the cross-section configuration of the plasma flame 54 is flat as shown in FIG. 3, the plasma flame is well bundled, and so, spray coating work against the substrate 56, especially micro-fine working is facilitated.

Figure 12:
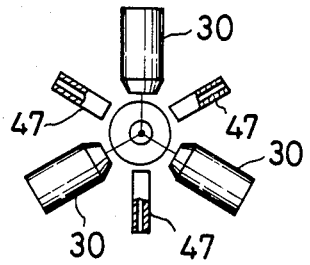
FIG. 12 is a cross-section view of a part corresponding to FIG. 11 in still another preferred embodiment.
Figure 13:
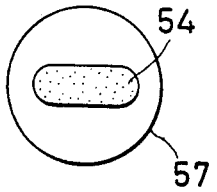
FIG. 13 is an enlarged cross-section view taken along line XIII—XIII in FIG. 1.
Figure 15:
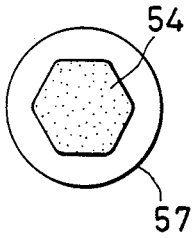
FIG. 15 is an enlarged cross-section view of a part corresponding to FIG. 14 in the preferred embodiment shown in FIG. 12.

This feature is further improved by increasing the number of the auxiliary torches 30 and the charging pipe 47, for instance, by employing three for each as shown in FIG. 12. In this case, the cross-section configuration of the plasma flame 54 forms a nearly regular hexagon as shown in FIG. 15.

The present invention should not be limited to only the preferred embodiments shown in FIGS. 1, 4, 6 and 8, but many embodiments based on the technical concept of the present invention is possible. With regard to the main torch 29, the present invention can be embodied by combining the basic mode shown in FIGS. 1, 4 and 6 with the preferred embodiments of the auxiliary torch 30 shown in FIGS. 1, 4 and 6, respectively. In this case, it is only required to make necessary change to the construction of the respective switches to be used for excitation on the basis of the technical concept of the present invention of sequentially shifting excitation arc towards the outside outer sheath. With regard to the plasma separating means, in some cases separation of plasma is possible with only a gas feed port, and as to the direction of gas feed for separation of plasma, also it can be appropriately determined on the basis of the technical concept of the present invention. Also as the plasma separating means, only a gas exhaust system can be used, or as the plasma separating means both the gas feed and the gas exhaust can be used in combination, and which one of these is to be selected may be appropriately determined depending upon its object of use, the size of the plasma flame, a gas flow rate, etc. With regard to the flame outer sheath 57 and the connecting chamber, if the apparatus is small-sized, in some cases they are not always necessary to be used, but in a large-sized apparatus, normally by making use of these members, violent light containing ultraviolet rays generated from the plasma flame can be shielded, and at the same time, lowering of temperature of the plasma flame can be prevented more effectively. As to the relative positioning between the main torch 29 and the auxiliary torch 30, while description was made with respect to the case the axes of these torches intersect at right angles to each other in every one of the above-described embodiments, preferred embodiments of the present invention need not be limited to such relative positioning, but depending upon the object of use, the angle of intersection between their axes and the relative distance therebetween can be chosen arbitrarily within the range where the plasma can be formed stably, and also the main torch 29 and the auxiliary torch 30 can be connected via a regulating device for these angle and distance. In many cases, it is more desirable to use a heat-insulating layer or a cooling device normally on the outside of the flame outer sheath 57, but these are not illustrated in the drawings. The apparatus according to the present invention can realize excellent characteristic features such as low noise, high strength, a low operating expense, etc. in the case where it is operated mainly in the range where the plasma forms a laminar flow, but it is also easy to generate high speed plasma by changing an operating condition, and in the case where it is desired to form a porous coating film at a high speed, it is also possible to operate the apparatus either in a laminar flow range or in a turbulent flow range.

A first advantage of the present invention is improvements in a working environment. In contrast to the fact that they spray coating apparatus in the prior art generated noises of the order of 100 to 120 phons, the apparatus according to the present invention normally generates noises of the order of only 70 to 80 phons. In addition, while a violent brilliant flame containing violent ultraviolet rays was generated in the spray coating apparatus in the prior art, in the apparatus according to the present invention a brilliant flame would not be exposed externally, and hence in most cases it has become possible to manipulate the apparatus without wearing protective glasses. Furthermore, in the case where a plasma separating gas exhaust port is used as the plasma separating means, as the gas and the unmolten coating film material produced by the plasma spray coating are directly collected at the outlet of the apparatus, contamination of the environment caused by exhaust gas or sputtering of the unmolten component is not present, hence spray coating can be practiced in an extremely good circumstance, and it has become possible to practice plasma spray coating in an equivalent environment to that for the conventional machine tools. Accordingly, in contrast to the fact that in the case of the heretofore known plasma spray coating apparatus, the apparatus had to be disposed within a sound-proof isolated room, only an operator equipped with sound-proof means and light-shielding glasses could operate the apparatus, and it was impossible to use the spray coating apparatus in a normal production line, according to the present invention the plasma spray coating apparatus can be installed as a normal working machine in the conventional production line without necessitating any special equipment such as an isolated room or the like.

A plasma spray coated film formed by the plasma spray coating method and apparatus according to the present invention has a strength equal to or 1.5 times as high as that of the coating film formed by the plasma spray coating apparatus in the prior art, and in this respect also, a remarkable improvement has been done.

In the plasma spray coating apparatus according to the present invention, since it has become possible to use gas that is remarkably rich in activity such as oxygen, air or the like as the plasma gas, spray coating of the material for which a coating film having a high performance could not be obtained by means of inert gas such as ferrite, oxide series ceramics, etc. becomes possible, and moreover, with regard to the materials for which spray coating could be done by means of the heretofore known spray coating apparatus, in the case of spray coating of oxide series, since spray coating can be done mostly by employing air as the plasma gas, the necessary amount of expensive inert gas can be reduced to a small amount, and thus an operating expense can be remarkably reduced. In addition, with regard to the inert gas such as argon or the like to be used as protective gas for the electrodes also, there is no need to use inert gas having an especially high purity, and in this respect also, the saving effect for an operating expense is remarkable.

In the plasma spray coating method and apparatus according to the present invention, since the speed of the plasma gas blown to the substrate is very slow, and furthermore, what strikes directly against the substrate is only a very small part of the plasma gas and molten liquid drops, a strong force would not act upon the substrate, hence the spray coating can be applied even to a substrate that is weak in mechanical strength, and further, since the plasma flame can be narrowed, microfine working can be carried out by the plasma spray coating. In the plasma spray coating apparatus according to the present invention, since the component parts where arc is directly terminated is surely protected by protective gas and water-cooled, wear of the apparatus is little, continuous operation of the apparatus over a long period of time is easy, in addition, excitation characteristics of the apparatus are also stable over a long period, and both excitation and stoppage can be practiced reliably and easily.

What is claimed is:

1. A multiple torch type plasma spray coating method, characterized by the steps of generating laminar flow plasma by means of a main torch associated with an auxiliary torch having an auxiliary cathode protected by inert gas, charging spray coating material into the plasma flame in the proximity of an outlet of said main plasma torch, blowing said plasma flame towards an object to be treated, separating plasma from said plasma flame just in front of the object to be treated, and making the then left spray coating material deposit onto the object to be treated.

2. A multiple torch type plasma spray coating method as claimed in claim 1, characterized in that the plasma flame in the proximity of the outlet of the main plasma torch where the spray coating material is charged, is a portion coexisting with arc generated from a cathode of said main plasma torch.

3. A multiple torch type plasma spray coating apparatus, characterized in that said apparatus comprises a main torch consisting of a main cathode, a main outer sheath, a main plasma gas charging port, and a main power source having its negative terminal connected to the main cathode and having its positive terminal connected via switch means to the main outer sheath; an auxiliary torch consisting of an auxiliary cathode, an auxiliary outer sheath, an auxiliary plasma gas charging port, and an auxiliary power source having its negative terminal connected via switch means to the auxiliary outer sheath and having its positive terminal connected to the auxiliary cathode and the positive terminal of the main power source; the main torch and the auxiliary torch being disposed so that their center axes may intersect each other; material charging means for charging spray coating material into a plasma flame formed by the main torch in the proximity of the outlet of the main torch; and plasma separating means provided downstream of the plasma flame in front of an object to be treated.

4. A multiple torch type plasma spray coating apparatus, characterized in that said apparatus comprises a main torch consisting of a main cathode, a main outer sheath, a main plasma gas charging port, and a main power source having its negative terminal connected to the main cathode and having its positive terminal connected via switch means to the main outer sheath; an auxiliary torch consisting of an auxiliary cathode, an auxiliary outer sheath, an auxiliary plasma gas charging port, an auxiliary second outer sheath, an auxiliary second gas charging port, and an auxiliary power source having its negative terminal connected via switch means to the auxiliary cathode and having its positive terminal connected to the auxiliary outer sheath and the positive terminal of the main power source; the main torch and the auxiliary torch being disposed so that their center axes may intersect each other; material charging means for charging spray coating material into a plasma flame formed by the main torch in the proximity of the outlet of the main torch; and plasma separating means provided downstream of the plasma flame in front of an object to be treated.

5. A multiple torch type plasma spray coating apparatus, characterized in that said apparatus comprises a main torch consisting of a main cathode, a main outer sheath, a main plasma gas charging port, a main second outer sheath, a main second plasma gas charging port, and a main power source having its negative terminal connected to the main cathode and having its positive terminal connected via switch means respectively to the main outer sheath and the main second outer sheath; an auxiliary torch consisting an auxiliary cathode an auxiliary outer sheath, an auxiliary plasma gas charging port, an auxiliary second outer sheath, an auxiliary second gas charging port, and an auxiliary power source having its negative terminal connected via switch means to the auxiliary cathode and having its positive terminal connected to the auxiliary outer sheath and the positive terminal of the main power source; the main torch and the auxiliary torch being disposed so that their center axes may intersect each other; material charging means for charging spray coating material into a plasma flame formed by the main torch in the proximity of the outlet of the main torch; and plasma separating means provided downstream of the plasma flame in front of an object to be treated.

6. A multiple torch type spray coating apparatus, characterized in that said apparatus comprises a main torch consisting of a main cathode, a main outer sheath, a main gas charging port, a main second outer sheath, a main second gas charging port, a main third outer sheath, a main third gas charging port, and a main power source having its negative terminal connected to the main cathode and having its positive terminal connected via switch means respectively to the main outer sheath, the main second outer sheath and the main third outer sheath; an auxiliary torch consisting of an auxiliary cathode, an auxiliary outer sheath, an auxiliary plasma charging port, an auxiliary second outer sheath, an auxiliary second gas charging port, and an auxiliary power source having its negative terminal connected via switch means to the auxiliary cathode and having its positive terminal connected to the auxiliary outer sheath and the positive terminal of the main power source; the main torch and the auxiliary torch being disposed so that their center axes may intersect with each other; material charging means for charging spray coating material into a plasma flame formed by the main torch in the proximity of the outlet of the main torch; and plasma separating means provided downstream of the plasma flame in front of an object to be treated.

7. A multiple torch type plasma spray coating apparatus, characterized in that said apparatus comprises a main torch consisting of a main cathode, a main outer sheath surrounding said main cathode and having an ejecting port, a main gas charging port, a main second outer sheath surrounding said main outer sheath and having a narrowed port, a main second gas charging port, and a main power source having its negative terminal connected to the main cathode and having its positive terminal connected via switch means respectively to the main outer sheath and the main second outer sheath; an auxiliary torch consisting of an auxiliary cathode, an auxiliary outer sheath surrounding said auxiliary cathode and having an ejecting port, an auxiliary gas charging port, an auxiliary second outer sheath surrounding said auxiliary outer sheath and having a narrowed port, an auxiliary second gas charging port, an auxiliary third outer sheath surrounding said auxiliary second outer sheath and having a narrowed port, an auxiliary third gas charging port, and an auxiliary power source having its negative terminal connected to the auxiliary cathode and having its positive terminal connected to the auxiliary outer sheath, either one of the connections being made via switch means; the positive terminal of said main power source being connected to said auxiliary outer sheath; the main torch and the auxiliary torch being disposed so that their center axes may intersect each other; material charging means for charging spray coating material into a plasma flame formed by the main torch in the proximity of the outlet of the main torch; and plasma separating means provided downstream of the plasma flame in front of an object to be treated.

8. A multiple torch type plasma spray coating apparatus, characterized in that said apparatus comprises a main torch consisting of a main cathode, a main outer sheath surrounding said main cathode and having an ejecting port, a main gas charging port, a main second outer sheath surrounding said main outer sheath and having a narrowed port, a second gas charging port, a main third outer sheath surrounding said main second sheath and having a narrowed port, a third gas charging port, and a main power source having its negative terminal connected to the main cathode and having its positive terminal connected via switch means respectively to the main outer sheath, the main second outer sheath and the main third outer sheath; an auxiliary torch consisting of an auxiliary cathode, an auxiliary outer sheath surrounding said outer cathode and having an ejecting port, an auxiliary gas charging port, an auxiliary second outer sheath surrounding said auxiliary outer sheath and having a narrowed port, an auxiliary second gas charging port, an auxiliary third outer sheath surrounding said auxiliary second outer sheath and having a narrowed port, an auxiliary third gas charging port, and an auxiliary power source having its negative terminal connected to the auxiliary cathode and having its positive terminal connected to the auxiliary outer sheath, either one of the connections being made via switch means; the positive terminal of said main power source being connected to said auxiliary outer sheath; the main torch and the auxiliary torch being disposed so that their center axes may intersect each other; material charging means for charging spray coating material into a plasma flame formed by the main torch in the proximity of the outlet of the main torch; and plasma separating means provided downstream of the plasma flame in front of an object to be treated.

9. A multiple torch type plasma spray coating apparatus as claimed in any one of claims 3 to 8, characterized in that said plasma separatihg means is a plasma separating gas feed port.

10. A multiple torch type plasma spray coating apparatus as claimed in any one of claims 3 to 8, characterized in that said plasma separating means is a plasma separating gas exhaust port.

11. A multiple torch type plasma spray coating apparatus as claimed in any one of claims 3 to 8, characterized in that said plasma separating means consists of combination use of a plasma separating gas feed port and a plasma separating gas exhaust port.

12. A multiple torch type plasma spray coating apparatus as claimed in any one of claims 3 to 8, characterized in that a flame outer sheath surrounding the plasma flame is provided between the main torch outlet and the plasma separating means.

13. A multiple torch type plasma spray coating apparatus as claimed in claim 12, characterized in that at least a part of the flame outer sheath is made of a porous or perforated member in order that the flame outer sheath can feed gas therethrough.

14. A multiple torch type plasma spray coating apparatus as claimed in claim 13, characterized in that the inner wall of the plasma flame outer sheath is made of refractory material.

15. A multiple torch type plasma spray coating apparatus as claimed in claim 14, characterized in that said apparatus comprises means for feeding gas downstream of said plasma separating means.

16. A multiple torch type plasma spray coating apparatus as claimed in claim 15, characterized in that a plurality of auxiliary torches are opposed to one another.

* * * * *